United States Patent [19]

Juergens

[11] 4,260,069

[45] Apr. 7, 1981

[54] INGREDIENT BIN COVER

[75] Inventor: David A. Juergens, Winchester, Va.

[73] Assignee: Rubbermaid Commercial Products Inc., Winchester, Va.

[21] Appl. No.: 138,824

[22] Filed: Apr. 10, 1980

[51] Int. Cl.[3] ..... B65D 43/14

[52] U.S. Cl. ..... 220/331; 220/345; 312/295

[58] Field of Search ..... 220/331, 345, 346, 8.1 T; 312/295, 299, 304; 229/7 SC; 217/62; 49/404, 371, 372, 373

[56] References Cited

U.S. PATENT DOCUMENTS

| | | | |
|---|---|---|---|
| 3,295,907 | 1/1967 | Galvin | 220/345 X |
| 4,230,381 | 10/1980 | Rhoades | 220/331 |

*Primary Examiner*—George T. Hall

*Attorney, Agent, or Firm*—Hamilton, Renner & Kenner

[57] ABSTRACT

A cover for an ingredient bin (15) having an upper opening (19,20), said cover having two movably associated parts (29 and 30) for closing the opening (19,20) when the parts are in extended position, and interengaging connection means (39 and 46) on said parts for permitting selectively hinging said sliding movement of said part (30) relative to said part (29) to give access through said opening (19,20).

18 Claims, 10 Drawing Figures

INGREDIENT BIN COVER

TECHNICAL FIELD

The invention relates generally to bins for storing and handling ingredients used in commercial, institutional and industrial applications such as kitchens and bakeries, and more particularly to normally closed bin covers providing ready access to the ingredients.

BACKGROUND ART

Certain prior ingredient bins have horizontal two-part lids with one part hinged to the other or slidably associated with the other. Such lids are not leak-proof against liquids spilled onto the tops thereof draining down into the bin in which ingredients such as flour, sugar and salt are stored. Certain other ingredient bins are provided with inclined openings covered by either hinged or slidable lids to provide ready access to the ingredients.

Difficulties have been experienced with these prior horizontal lids in that they do not provide ready access to the ingredients when the bin is located under a preparation table, and the covers for the bins having inclined openings require holding the lid open if the lid is hinged, or require sliding it horizontally to open position if the lid is telescopically slidable. Further difficulties include the tendency of the two-part slidable lids to jam when telescoped one part into the other, particularly where the lids or parts thereof are metal.

DISCLOSURE OF THE INVENTION

The present invention embodies a two-part cover entirely of clear plastic designed for quick detachable mounting on an ingredient bin having an upper opening which may have an inclined portion, said cover adapted to overcome the difficulties presented by prior bin covers.

It is an object of the present invention to provide an improved two-part cover for an ingredient bin with an upper opening, one part being both hinged and slidable with respect to the other part.

Another object is to provide improved means providing detachable connection between the cover and the bin.

A further object is to provide an improved cover of clear plastic material for such a bin having two parts constructed selectively to be indexed or telescoped together for self-storing and removal, and extended to completely cover the bin.

Another object is to provide an improved cover of plastic material for such a bin having two movably associated parts constructed to divert liquid from their upper surfaces away from the bin opening covered thereby.

A still further object is to provide an improved cover having two movably associated parts, one part covering an inclined portion of the opening of an ingredient bin having connected horizontal and inclined portions, said one part detachable from the other part only by telescopically sliding said one part over said other part.

These and other objects are accomplished by the improvements comprising the present invention, a preferred embodiment of which is disclosed and described herein as exemplifying the best known mode of carrying out the invention. Various modifications and changes in details of construction are comprehended within the scope of the appended claims.

PREFERRED EMBODIMENT OF THE INVENTION

Figure 1:
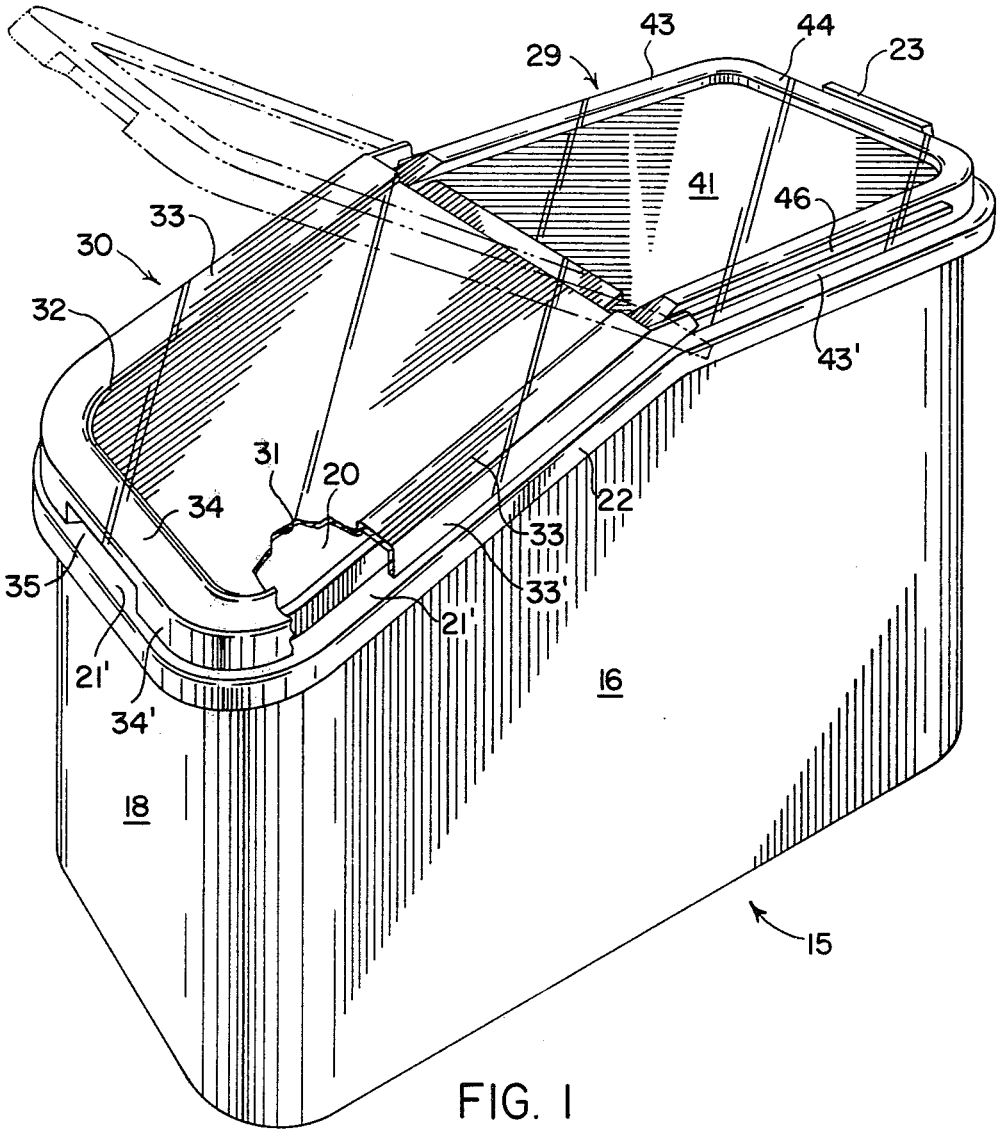
FIG. 1 is a perspective view, partly broken away, showing the improved cover closing an ingredient bin having an opening with a horizontal and an inclined portion, and showing in phantom lines the part over the inclined opening swung to an open position.

The improved cover is shown in the drawings applied to an ingredient bin indicated generally at 15 having vertically disposed side walls 16 and end walls 17 and 18. The upper ends of side walls 16 and end wall 17 form a horizontal upper opening portion 19, and the upper ends of side walls 16 and end wall 18 form an inclined upper opening portion 20 communicating or connected with the opening portion 19. An exterior flange 21 with a downturned outer lip 22 extends continuously around the side walls 16 and end walls 17 and 18 a short distance below the tops thereof. Around the inclined upper opening portion 20 of the side and end walls the portions 21' of flange 21 are inclined parallel with the upper ends of the side walls 16.

Figure 2:
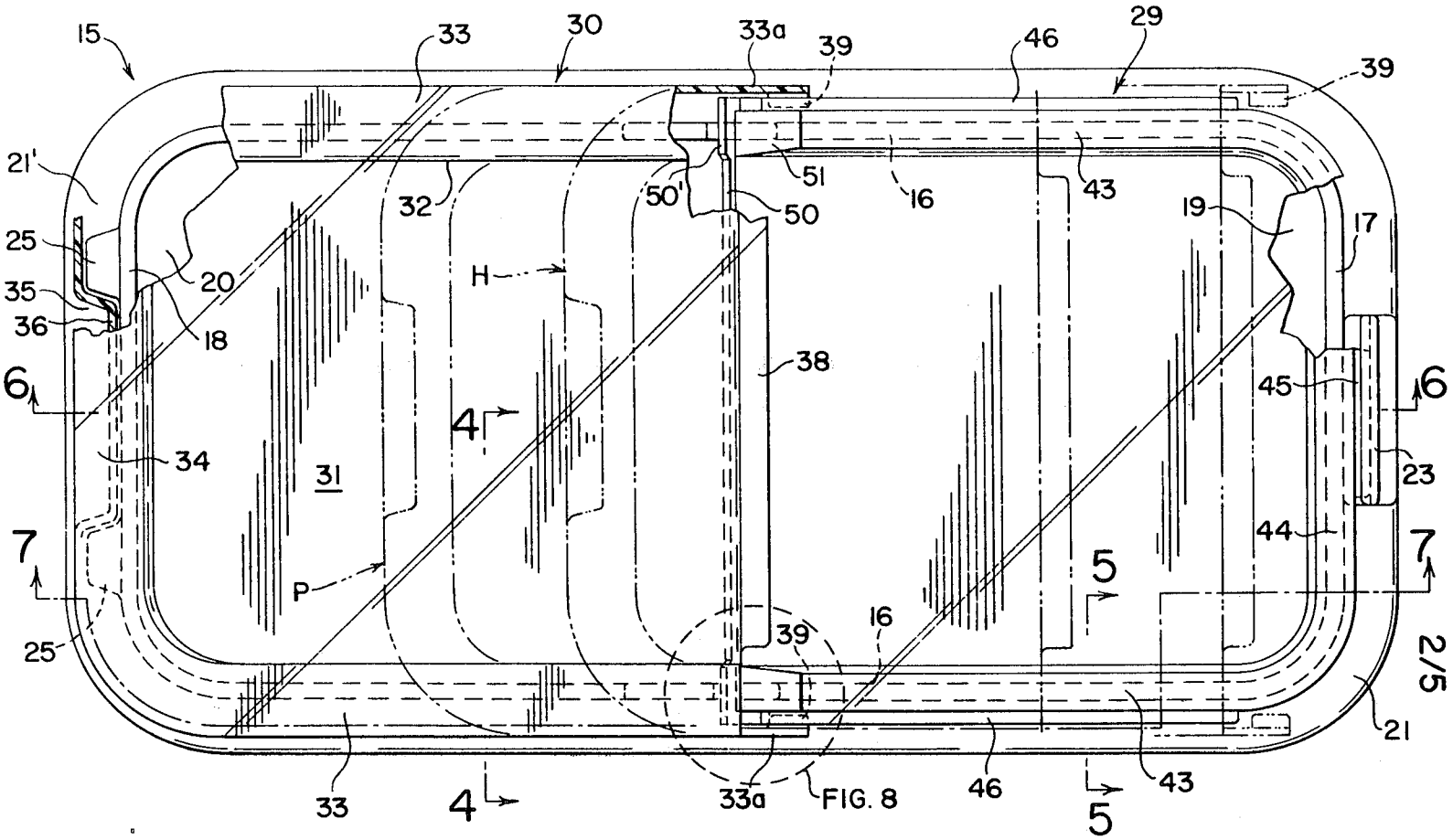
FIG. 2 is a top plan view, partly broken away, and showing in phantom lines the part over the inclined opening slidably indexed over the other part.
Figure 6:
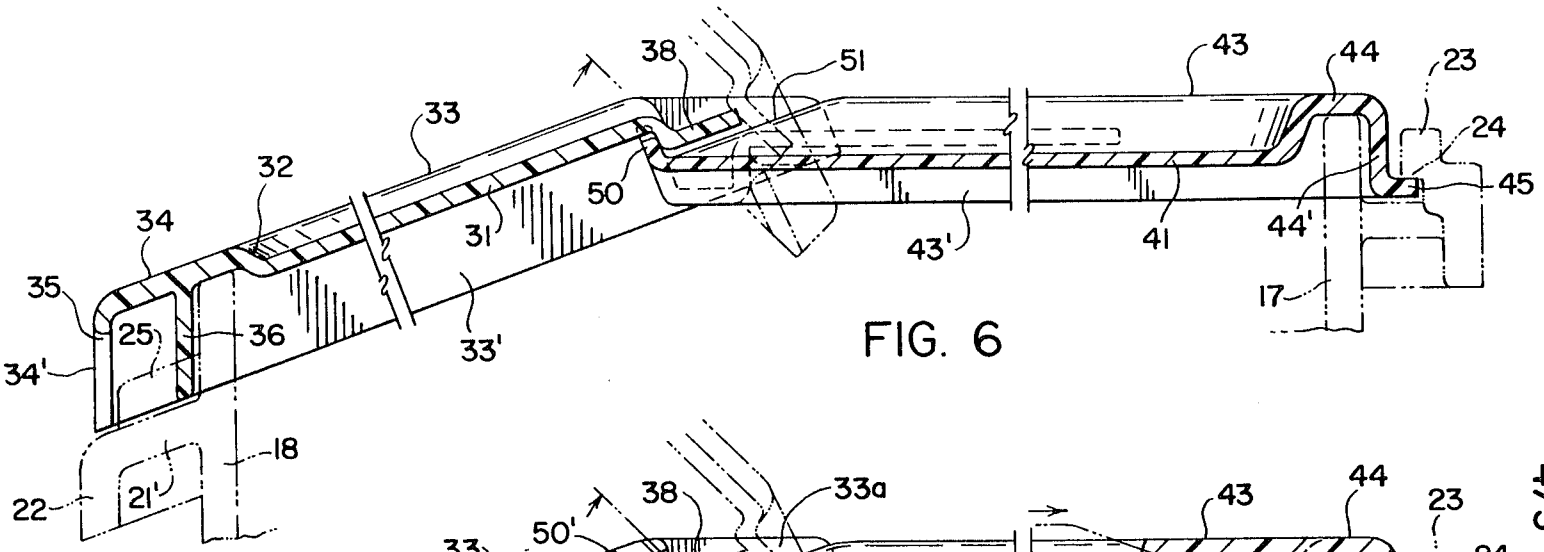
FIG. 6 is a fragmentary sectional view on line 6—6 of FIG. 2.

As best shown in FIGS. 2 and 6, the median part of the flange 21 on end wall 17 is extended upwardly to form a tab 23 having an undercut portion 24 for a purpose to be described. Above the end flange 21' two laterally spaced lugs 25 extend outwardly from the end wall 18 in parallelism with the flange 21', for a purpose to be described.

The cover comprises two parts, preferably of transparent rigid plastic material, for example, polycarbonate. One part, sometimes referred to as the rear part, is indicated generally at 29 and covers the horizontal opening, and the other or front part is indicated generally at 30 and covers the inclined opening 20. Preferably, the central area of the top wall 31 of part 30 is formed with a recess 32 which forms raised rim side portions 33 and end portion 34 extending continuously around the sides and lower end of the part. Outer flanges 33' and 34' depend from the rim portions 33 and 34, respectively, and the flange 34' may be inclined so as to be parallel to end wall 18 and its outer lip 22. Across the medial portion of flange 34' is an inward recess 35 forming a hand hold with an inner wall 36, and the recess fits between the centering lugs 25 on the end wall of the bin when the cover part 30 is closed, as shown in FIG. 2.

As shown in FIGS. 2 and 6, the rim portions 33 terminate at the upper edge of top wall 31, and an angular flange 38 extends downwardly and then upwardly from the top wall between the ends of the rim portions 33. The side rim flanges 33' have upper or inner arms 33*a* extending a short distance beyond the ends of rim portions 33 and may have their top edges inclined or beveled, and similarly inclined lugs 39 may extend inwardly from the bottom edges of arms 33*a*, for a purpose to be described.

The cover part 29 for the horizontal opening 19 of the bin 15 preferably has a recessed top wall 41 forming raised rim side portions 43 and end portion 44 extending continuously around the sides and outer end of the part. Outer flanges 43' and 44' depend from the rim portions 43 and 44, respectively. As shown in FIGS. 2 and 6, an angular flange 45 extends outwardly from the medial portion of the bottom edge of rim flange 44', and in the closed position of cover part 29 the flange 45 engages under the undercut portion 24 of tab 23 on the bin and locks the cover part 29 in place. Longitudinal guide rails or ribs 46 are provided on the exterior surfaces of the flanges 43'.

As indicated in FIGS. 4–7, when the two cover parts are in closed position over the bin, the upper ends of the bin side and end walls abut the undersides of the rim portions 33 and 34 of cover part 30, and the undersides of the rim portions 43 and 44 of cover part 29, with the rim flanges 33', 34', 43' and 44' extending downwardly exteriorly of the bin walls. The manner of connecting the cover parts 29 and 30 for permitting selective sliding or hinging of part 30 with respect to part 29 will now be described.

Figure 3:
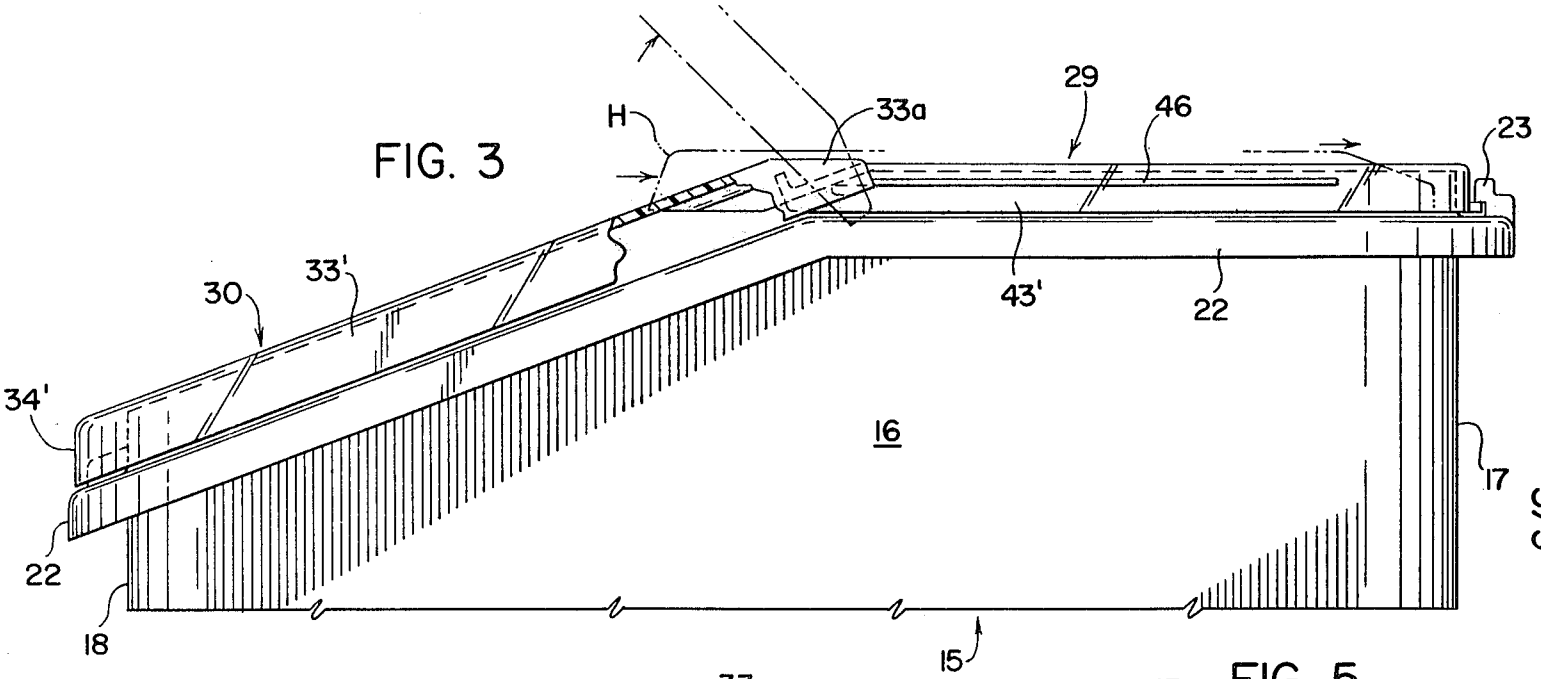
FIG. 3 is a side elevation, partly broken away.
Figure 5:
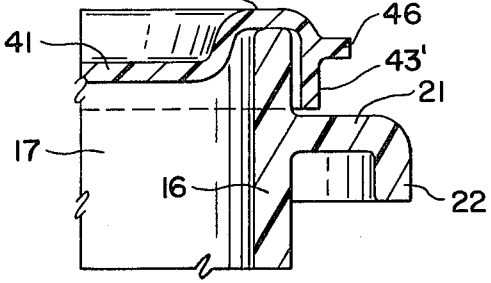
FIG. 5 is a fragmentary sectional view on line 5—5 of FIG. 2.
Figure 4:
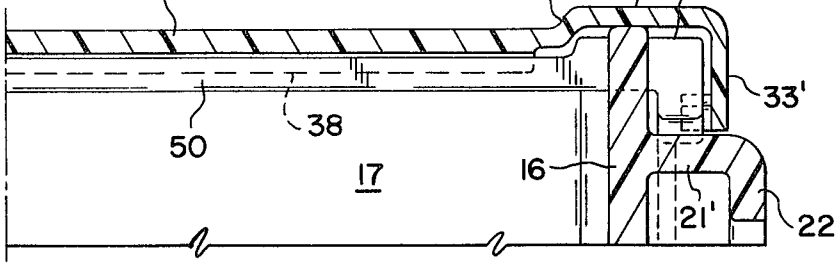
FIG. 4 is a fragmentary sectional view on line 4—4 of FIG. 2.

As indicated in FIGS. 2 and 4, the rim flanges 33' of part 30 are spaced laterally outward of the rails 46 on flanges 43', and the inclined lugs 39 extend laterally inward under the longitudinal ribs 46 to allow the part 30 to slide over the part 29 when part 30 is raised to horizontal position, the height of the side flanges 33' and top wall 31 being such as to allow rim portions 33 and angular flange 38 to slide over rim portions 43 and top wall 41, respectively, as indicated in phantom lines H in FIGS. 2 and 3.

Figure 7:
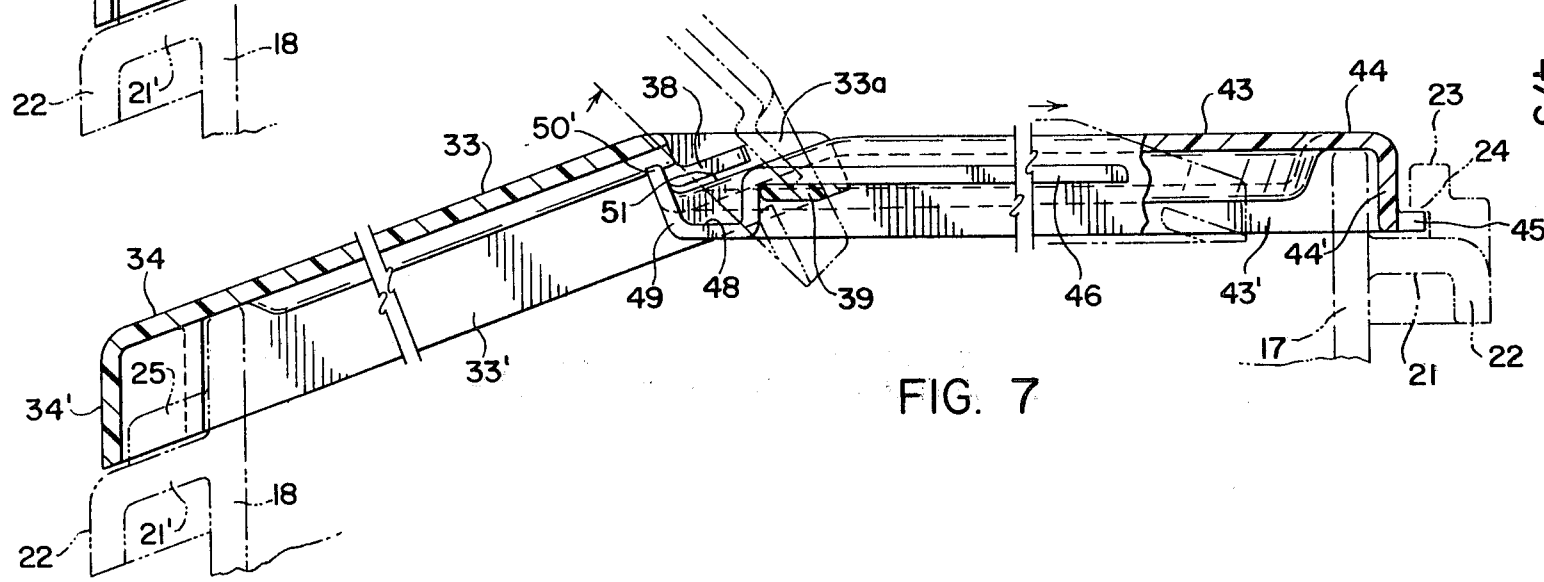
FIG. 7 is a fragmentary sectional view on line 7—7 of FIG. 2.
Figure 8:
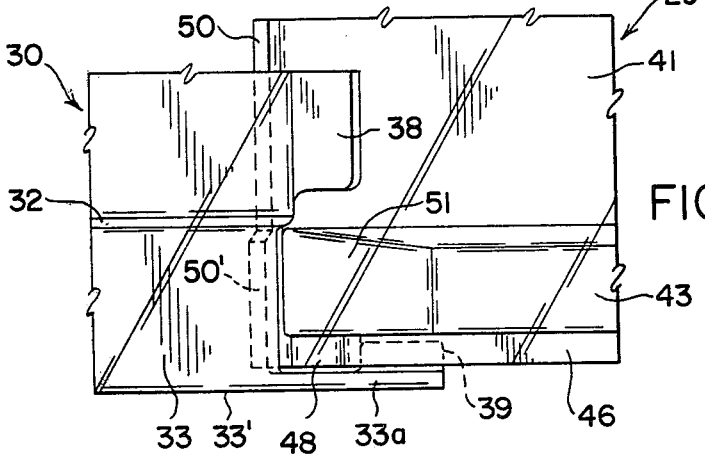
FIG. 8 is an enlarged partial top plan view of the area designated by the dotted circle in FIG. 2.
Figure 9:
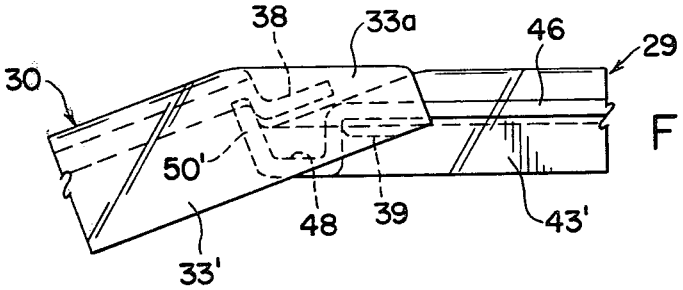
FIG. 9 is a side elevation thereof.

The inner ends of guide rails 46 are formed into downwardly extending troughs or channels 48 best shown in FIGS. 6–8, the upper ends of the inner legs 49 of the channels merging into a transverse upturned flange 50 extending across the inner edge of the top wall 41 and having upwardly extended end portions 50'. Adjacent to the channels 48 the rim portions 43 slope downwardly as indicated at 51 to merge into the top wall 41 at its juncture with the transverse flange 50, so that any moisture collecting on the upper surface of top wall 41 can drain laterally into the channels 48 outside of the bin walls 16.

In the extended or closed position of the parts 29 and 30 completely covering the bin openings 19 and 20, as indicated in FIGS. 1–3, the rounded inner ends of lugs 39 abut the inner legs of channels 48 to prevent further downward sliding of part 30 as best seen in FIG. 7, while the upper inclined surfaces of the lugs are in planar contact with the undersurfaces of the guide rails 46, so that the rounded ends of lugs 39 provide a rolling or hinge contact with the channels 48 allowing part 30 to swing upwardly as indicated in phantom lines in the various figures of the drawing.

The contact of the upper surfaces of lugs 39 with the undersurfaces of the ribs 46 limits the downward swinging movement of part 30 and further downward sliding movement is also limited by the engagement of transverse flange 50 behind flange 38 on the inner edge of top wall 43. As indicated in FIG. 4, the end portions 50' of flange 50 are of slightly increased height to fit under rim portions 33 of part 30.

Figure 10:
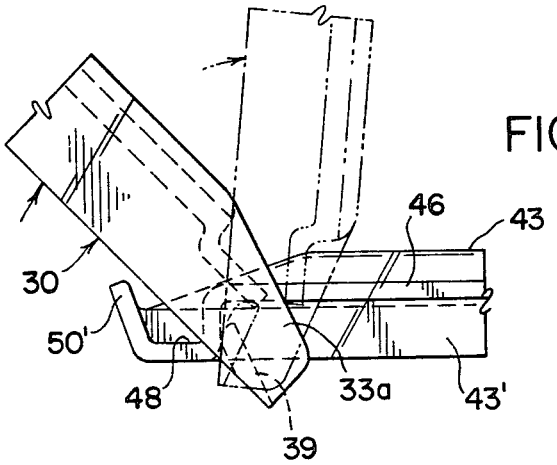
FIG. 10 is a similar view showing the inclined part swung to a partial open position and a fully open position in phantom lines.

In the operation of the improved ingredient bin cover, assuming that the parts are in the closed position covering the ingredient bin 15, in order to gain temporary access into the ingredients stored in the bin the operator may swing part 30 upwardly to a position such as shown in phantom in FIG. 1 and hold it there momentarily while extracting some of the ingredients. If he wants to keep the part 30 fully open for some time and the space above the part is unobstructed he may swing part 30 farther upward to the phantom position of FIG. 10, where flange 38 will act as a stop against the top wall 41.

If the operator wants to open part 30 a small amount and have it remain there for a time, he may swing the part upwardly to a horizontal position and slide it part way over part 29 to a position such as indicated at P in FIG. 2, in which the engagement of lugs 39 under rails 46 will maintain it in place. If the space above cover part 30 is obstructed as by a preparation table, the operator may maintain part 30 in the fully open position by sliding it horizontally over part 29 to the phantom position H of FIG. 2. In all positions moisture spilled or collected on the upper surface of wall 41 of part 29 will be retained by flange 50 and can drain laterally into the channels 48 which are outside of the bin walls. Moisture on recessed wall 31 can, of course, drain downwardly over rim portion 34. As seen in FIG. 8, there is a clearance between the channels 48 and the extended arms 33*a* of rim flanges 33' to drain off excess moisture.

Obviously, the rear and front cover parts 29 and 30 can be applied to a bin having a fully horizontal upper opening, with part 29 covering the rear portion of the opening and part 30 covering the front portion thereof.

When the part 30 is slid to the position H of FIG. 1, the lugs 39 clear the outer ends of rails 46, so that the part 30 may be lifted off part 29. The part 29 may be removed from the bin by rotating the part around the undercut portion 24 of tab 23 to disengage flange 45. The parts 29 and 30 may be removed and telescoped together for storing and shipping.

I claim:

1. In combination with an ingredient bin having side walls with their upper ends forming an opening, a cover having a rear part and a front part movably associated therewith, said parts when extended closing said opening, one part having exterior side rails and the other part having lugs projecting laterally inward for rockable and slidable engagement with said rails, thereby permitting both hinging and sliding movement of said front part to give access to said opening.

2. A combination as described in claim 1, wherein the two parts of said cover comprise wholly transparent plastic material.

3. A combination as described in claim 2, wherein said rear part has a transverse retainer flange extending along its inner edge to divert liquid laterally outwardly from the upper surface of said rear part.

4. A combination as described in claim 2, wherein the bin and said rear cover part are provided with interengaging flange means to retain said cover on the upper ends of said bin side walls.

5. A combination as described in claim 1, wherein said bin opening has a rear horizontal and a front inclined portion, said rear and front parts of the cover when extended closing said entire bin opening.

6. A combination as described in claim 5, wherein the two parts of said cover comprise wholly transparent plastic material.

7. A combination as described in claim 5, wherein said rear part has a transverse retainer flange extending along its inner edge to divert liquid laterally outwardly from the upper surface of said rear part.

8. A combination as described in claim 5, wherein the bin and said rear cover part are provided with interengaging flange means to retain said cover on the upper ends of said bin side walls.

9. A cover for an ingredient bin having side walls with their upper ends forming an opening, said cover having a rear part and a front part movably associated therewith, said parts when extended closing said opening, one part having exterior side rails and the other part having lugs projecting laterally inward for rockable and slidable engagement with said rails, thereby permitting both hinging and sliding relative movement of said front part to give access to said opening.

10. A cover as described in claim 9, wherein the rear cover part is adapted to cover a horizontal bin opening and the front part is adapted to cover an inclined opening connected to the horizontal opening.

11. A cover as described in claim 10, wherein said rear cover part has a transverse retainer flange extending along its inner edge to divert liquid laterally outward from the upper surface of said rear part.

12. A cover as described in claim 11, wherein downwardly extending channels are formed at the outer ends of said retainer flange to receive liquid diverted laterally from the upper surface of said rear part.

13. A cover as described in claim 12, wherein said side rails are formed on said rear cover part, and said channels are formed at the inner ends of said rails.

14. A cover as described in claim 13, wherein said laterally projecting lugs are formed at the inner end of said front cover part and engage said rails behind said channels when said cover parts are extended.

15. A cover as described in claim 9, wherein the two parts of said cover in their entirety comprise transparent plastic material.

16. A cover as described in claim 15, wherein said rear cover part has a transverse retainer flange extending along its inner edge to divert liquid laterally outward from the upper surface of said rear part.

17. A cover as described in claim 16, wherein said rear cover part has a rearwardly extending flange adapted to detachably interlock with said ingredient bin.

18. A cover as described in claim 16, wherein downwardly extending channels are formed at the outer ends of said retainer flange to receive liquid diverted laterally from the upper surface of said rear part.

* * * * *